US006675756B2

(12) United States Patent
Katayama

(10) Patent No.: US 6,675,756 B2
(45) Date of Patent: Jan. 13, 2004

(54) AIR INDUCTION SYSTEM FOR ENGINE

(75) Inventor: Goichi Katayama, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 216 days.

(21) Appl. No.: 09/982,146

(22) Filed: Oct. 17, 2001

(65) Prior Publication Data

US 2002/0073971 A1 Jun. 20, 2002

(30) Foreign Application Priority Data

Oct. 17, 2000 (JP) ..... 2000-317137

(51) Int. Cl.[7] ..... F02M 35/10

(52) U.S. Cl. ..... 123/184.34; 123/184.37; 123/184.42; 123/184.59

(58) Field of Search ..... 123/184.34, 184.37, 123/184.42, 184.45, 184.47, 184.52, 184.59

(56) References Cited

U.S. PATENT DOCUMENTS 5,002,021 A * 3/1991 Nakata et al. ..... 123/184.42
5,450,830 A 9/1995 Katoh
5,584,281 A 12/1996 Katoh
5,655,500 A 8/1997 Kato
5,715,793 A 2/1998 Motose

FOREIGN PATENT DOCUMENTS

JP 9-126025 5/1997

* cited by examiner

*Primary Examiner*—Bibhu Mohanty
(74) *Attorney, Agent, or Firm*—Knobbe, Martens, Olson & Bear LLP

(57) ABSTRACT

An air induction system for an engine is provided with a flow meter to sense a flow amount of air introduced into a combustion chamber of the engine. The air induction system includes an improved construction that can protect the flow meter from rigorous environment. The construction includes a primary intake passage through which the air flows. A secondary intake passage extends from the primary passage to communicate with the primary passage. At least a portion of the air flows through the secondary passage. A filter is disposed in the secondary passage to filtrate the portion of the air. The flow meter is positioned downstream of the filter in the secondary passage.

30 Claims, 6 Drawing Sheets

AIR INDUCTION SYSTEM FOR ENGINE

PRIORITY INFORMATION

This application is based on and claims priority to Japanese Patent Application No. 2000-317137, filed Oct. 17, 2000, the entire contents of which is hereby expressly incorporated by reference.

BACKGROUND OF THE INVENTION

1. Field of the Invention

The present invention generally relates to an air induction system for an engine, and more particularly relates to an improved air induction system which includes an airflow sensor.

2. Description of Related Art

An internal combustion engine typically has an air induction system including one or more air intake passages that introduces air into one or more combustion chambers of the engine. Typically, each intake passage is provided with a throttle valve that regulates or measures an amount of the air (i.e., controls the airflow rate) passing through the intake passage. The throttle valves are operable by an operator of the engine through an appropriate linkage connecting the throttle valves with an operation device, such as, for example, a throttle lever. The induction system, thus, can deliver a desired amount of air to the combustion chambers.

Such an engine also typically has an ignition system that ignites an air/fuel charge formed in the combustion chambers. A control device such as, for example, an electronic control unit (ECU) is provided to control ignition timing of the ignition system. In some arrangements, the engine can have a fuel injection system that sprays fuel directly or indirectly to the combustion chambers. Injection timing and duration of the fuel injection system also can be controlled by the ECU. Various sensors are provided to sense engine conditions and/or environmental conditions around the engine. These sensors generally send signals to the ECU. The ECU often uses the signals from the sensors to control the ignition system and/or the fuel injection system.

It would be advantageous for the ECU to receive information relating to a current amount of air flowing through the intake passages. Such information can be used in determining desired operating parameters. Usually, a throttle valve position sensor is used for such a purpose. The throttle valve position sensor is coupled with at least one shaft of the throttle valves to sense an angular position of the shaft. The sensor then can send a signal to the ECU. The signal normally is used as a proxy for the current amount of air flow based upon an assumption that the angular position of the throttle valves generally are proportional to the air flow amount. Actually, however, the angular position signal does not completely correspond to the air flow amount because the air flow amount does not necessarily vary linearly relative to the angular position of the throttle valve.

Inaccuracy of the information as to the air flow amount can cause inaccurate control by the ECU and inefficient engine operation. For instance, operating at or near the optimum air/fuel ratio results in greatly reduced emissions. Typically, an amount of fuel is determined to keep the air/fuel ratio in this optimum ratio. The ECU thus controls the injection timing and duration based upon the signal indicating the air amount to determine the air/fuel ratio. If the air amount information is be inaccurate, then the ECU would not be able to accurately calculate a proper fuel injection timing and duration and the air/fuel ratio would deviate from the optimum ratio.

In order to more accurately sense the air amount, an air flow meter can be used. However, currently available flow meters are quite fragile and do not admit to application in rough environmental applications, such as outboard motors. For instance, if the engine is used at sea, salt water can corrode and deteriorate the flow meter. If the engine is used in dusty surroundings, fine particles can also deteriorate the flow meter. In addition, while being used under such conditions, the useful life of the flow meter can be expected to be shortened.

A need therefore exists for an improved air induction system that can protect a flow meter.

In general, limited space may be available for such a protective construction because, in the field of outboard motors, compact construction is a rather significant design parameter. For instance, engines for outboard motors typically are surrounded by a cowling and minimal space is provided for each engine component or device.

Another need thus exists for an improved air induction system that can be compactly constructed will continuing to provide protection to a flow meter.

SUMMARY OF THE INVENTION

In accordance with one aspect of the present invention, an internal combustion engine comprises an engine body. A moveable member is moveable relative to the engine body. The engine body and the moveable member together define a combustion chamber. An air induction system is arranged to introduce air into the combustion chamber. The air induction system includes a primary intake passage through which the air flows. A secondary intake passage extends from the primary passage to communicate with the primary passage. At least a portion of the air flows through the secondary passage. A filter is disposed in the secondary passage to filtrate the portion of the air. An airflow sensor is positioned downstream of the filter in the secondary passage to sense a flow amount of the portion of the air.

In accordance with another aspect of the present invention, an internal combustion engine comprises an engine body. A plurality of moveable members are moveable relative to the engine body. The engine body and the moveable members together define a plurality of combustion chambers. An air induction system is arranged to introduce air into the combustion chambers. The air induction system includes a voluminous member defining a plenum chamber. A plurality of intake conduits define at least portions of intake passages connecting the plenum chamber with the combustion chambers. A recessed member is coupled with the voluminous member to define an air passage communicating with the plenum chamber. A filter is disposed within the air passage to divide the air passage into upstream and downstream portions. A flow meter is positioned in the downstream portion to sense a flow amount of the air flowing through the air passage.

In accordance with a further aspect of the present invention, an internal combustion engine comprises an engine body. A moveable member is moveable relative to the engine body. The engine body and the moveable member together define a combustion chamber. An air induction system is arranged to introduce air into the combustion chamber. The air induction system includes an intake conduit through which the air flows. A side conduit extends from the intake conduit. At least a portion of the air flows through the side conduit. A filter is disposed in the side conduit to filtrate the portion of the air. Means are provided for sensing a flow amount of the portion of the air. The sensing means are positioned downstream of the filter in the side conduit.

BRIEF DESCRIPTION OF THE DRAWINGS

These and other features, aspects and advantages of the present invention will now be described with reference to the drawings of three presently preferred embodiments, which embodiments are intended to illustrate and not to limit the present invention. The drawings comprise six figures.

DETAILED DESCRIPTION OF THE PREFERRED EMBODIMENTS OF THE INVENTION

Figure 1:
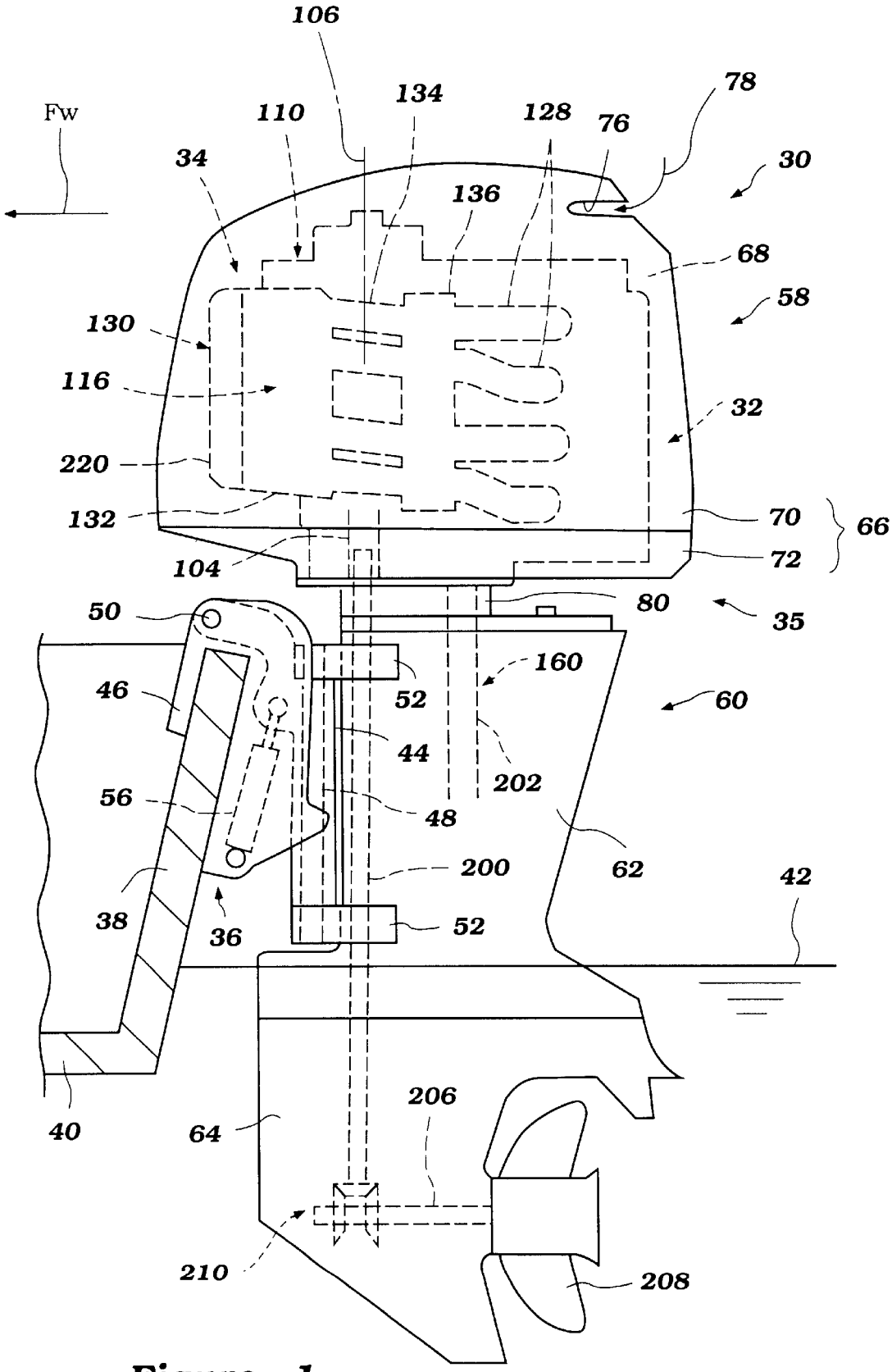
FIG. 1 is a side elevation view of an outboard motor employing an engine that has an air induction system configured in accordance with certain features, aspects and advantages of the present invention. An associated watercraft is partially shown.
Figure 2:
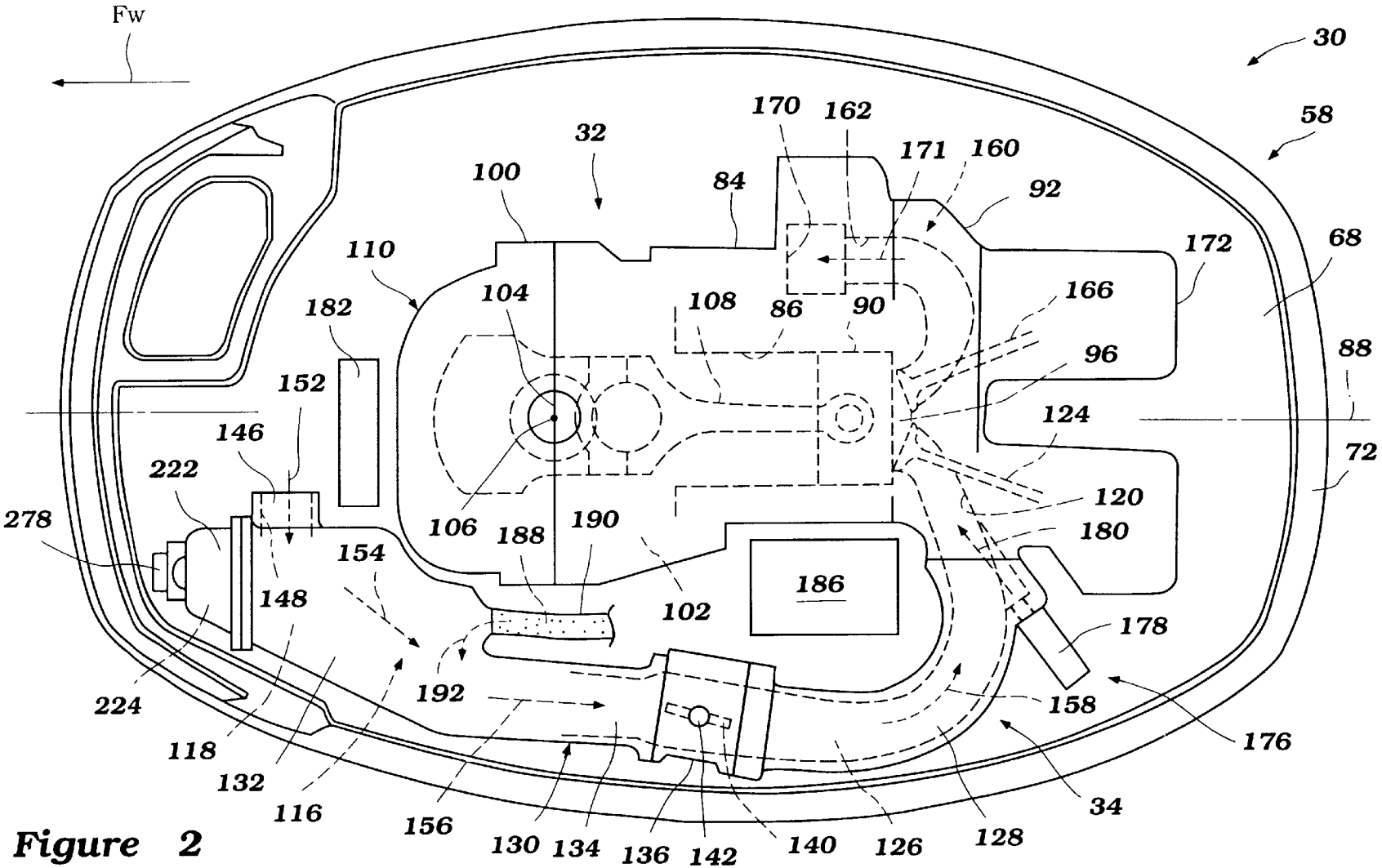
FIG. 2 is a top plan view of the outboard motor of FIG. 1. A top cowling member is shown removed to better illustrate certain portions of the engine.

With reference to FIGS. 1 and 2, an overall construction of an outboard motor 30 that employs an internal combustion engine 32 having an air induction system 34 configured in accordance with certain features, aspects and advantages of the present invention will be described. The engine 32 has particular utility in the context of a marine drive, such as an outboard motor, for instance, and thus is described in the context of an outboard motor. The engine 32, however, can be used with other types of marine drives (i.e., inboard motors, inboard/outboard motors, etc.) and also certain land vehicles, which includes lawnmowers, motorcycles, go carts, all terrain vehicles and the like. Furthermore, the engine 32 can be used as a stationary engine for some applications.

In the illustrated arrangement, the outboard motor 30 generally comprises a drive unit 35 and a bracket assembly 36. The bracket assembly 36 supports the drive unit 35 on a transom 38 of an associated watercraft 40 and places a marine propulsion device in a submerged position with the watercraft 40 resting relative to a surface 42 of a body of water. The bracket assembly 36 preferably comprises a swivel bracket 44, a clamping bracket 46, a steering shaft 48 and a pivot pin 50.

The steering shaft 48 typically extends through the swivel bracket 44 and is affixed to the drive unit 35 by top and bottom mount assemblies 52. The steering shaft 48 is pivotally journalled for steering movement about a generally vertically extending steering axis defined within the swivel bracket 44. The clamping bracket 46 comprises a pair of bracket arms that preferably are laterally spaced apart from each other and that are attached to the watercraft transom 38.

The pivot pin 50 completes a hinge coupling between the swivel bracket 44 and the clamping bracket 46. The pivot pin 50 preferably extends through the bracket arms so that the clamping bracket 46 supports the swivel bracket 44 for pivotal movement about a generally horizontally extending tilt axis defined by the pivot pin 50. The drive unit 35 thus can be tilted or trimmed about the pivot pin 50.

As used through this description, the terms "forward," "forwardly" and "front" mean at or to the side where the bracket assembly 36 is located, unless indicated otherwise or otherwise readily apparent from the context use. The arrows Fw in the figures generally indicate the forward direction. The terms "rear," "reverse," "backwardly" and "rearwardly" mean at or to the opposite side of the front side.

A hydraulic tilt and trim adjustment system 56 preferably is provided between the swivel bracket 44 and the clamping bracket 46 for tilt movement (raising or lowering) of the swivel bracket 44 and the drive unit 35 relative to the clamping bracket 46. Otherwise, the outboard motor 30 can have a manually operated system for tilting the drive unit 35. Typically, the term "lilt movement", when used in a broad sense, comprises both a tilt movement and a trim adjustment movement.

The illustrated drive unit 35 comprises a power head 58 and a housing unit 60, which includes a driveshaft housing 62 and a lower unit 64. The power head 58 is disposed atop the housing unit 60 and includes an internal combustion engine 32 that is positioned within a protective cowling assembly 66, which preferably is made of plastic. In most arrangements, the protective cowling assembly 66 defines a generally closed cavity 68 in which the engine 32 is disposed. The engine 32, thus, is generally protected from environmental elements within the enclosure defined by the cowling assembly 66.

The protective cowling assembly 66 preferably comprises a top cowling member 70 and a bottom cowling member 72. The top cowling member 70 preferably is detachably affixed to the bottom cowling member 72 by a coupling mechanism so that a user, operator, mechanic or repairperson can access the engine 32 for maintenance or for other purposes. In some arrangements, the top cowling member 70 is hingedly attached to the bottom cowling member 72 such that the top cowling member 70 can be pivoted away from the bottom cowling member for access to the engine 32. Preferably, such a pivoting allows the top cowling member 70 to be pivoted about the rear end of the outboard motor 30, which facilitates access to the engine 32 from within the associated watercraft 40.

The top cowling member 70 preferably has a rear intake opening 76 defined through an upper rear portion. A rear intake member with one or more air ducts is unitarily formed with or is affixed to the top cowling member 70. The rear intake member, together with the upper rear portion of the top cowling member 70, generally defines a rear air intake space. Ambient air is drawn into the closed cavity 68 via the rear intake opening 76 and the air ducts of the rear intake member as indicated by the arrow 78 of FIG. 1.

Typically, the top cowling member 70 tapers in girth toward its top surface, which is in the general proximity of the air intake opening 76. The taper helps to reduce the lateral dimension of the outboard motor, which helps to reduce the air drag on the watercraft during movement.

The bottom cowling member 72 preferably has an opening through which an upper portion of an exhaust guide member 80 extends. The exhaust guide member 80 preferably is made of aluminum alloy and is affixed atop the driveshaft housing 62. The bottom cowling member 72 and the exhaust guide member 80 together generally form a tray. The engine 32 generally is disposed at a location above the exhaust guide member 80 and, in one arrangement, the engine 32 is placed onto the tray and can be affixed to the exhaust guide member 80. The exhaust guide member 80 also defines an exhaust discharge passage through which burnt charges (e.g., exhaust gases) from the engine 32 pass.

The engine 32 in the illustrated embodiment preferably operates on a four-cycle combustion principle. With reference now to FIG. 2, the presently preferred engine 32 has a cylinder block 84 defining four cylinder bores 86. The cylinder bores 86 extend generally horizontally along a longitudinal center plane 88 extending vertically and fore to aft of the outboard motor 30, and are generally vertically spaced from one another. Thus, the engine is an inline four cylinder (L4). This type of engine, however, merely exemplifies one type of engine on which various aspects and features of the present invention can be suitably used. Engines having other numbers of cylinders, having other cylinder arrangements (V-shape, opposing, etc.), and operating on other combustion principles (e.g., crankcase compression two-stroke or rotary) also can employ various features, aspects and advantages of the present invention. In addition, the engine can be formed with separate cylinder bodies rather than a number of cylinder bores formed in a cylinder block. Regardless of the particular construction, the engine preferably comprises an engine body that includes at least one cylinder bore.

As used in this description, the term "horizontally" means that the subject portions, members or components extend generally in parallel to the water surface 42 (i.e., generally normal to the direction of gravity) when the associated watercraft 40 is substantially stationary with respect to the water surface 42 and when the drive unit 35 is not tilted (i.e., is placed in the position shown in FIG. 1). The term "vertically" in turn means that portions, members or components extend generally normal to those that extend horizontally.

A moveable member moves relative to the cylinder block 84 in a suitable manner to at least partially define a combustion chamber. In the illustrated arrangement, a piston 90 reciprocates within each cylinder bore 86 to define a variable volume combustion chamber. A cylinder head member 92 is affixed to a rear end of the cylinder block 84 to close those ends of the cylinder bores 86 on this side. The cylinder head member 92 together with the associated pistons 90 and cylinder bores 86 preferably define four combustion chambers 96. Of course, the number of combustion chambers can vary, as indicated above.

A crankcase member 100 is affixed to the other end, i.e., a front end, of the cylinder block 84 to close the cylinder bores 86 on this side, and, together with the cylinder block 84, defines a crankcase chamber 102. A crankshaft 104 extends generally vertically through the crankcase chamber 102 and can be journalled for rotation about a rotational axis by several bearing blocks. The rotational axis 106 of the crankshaft 104 preferably is on the longitudinal center plane 88. Connecting rods 108 couple the crankshaft 104 with the respective pistons 90 in any suitable manner. Thus, the reciprocal movement of the pistons 90 rotates the crankshaft 104.

Preferably, the crankcase member 100 is located at the forward-most position of the engine 32, with the cylinder block 84 and the cylinder head member 92 being disposed rearward from the crankcase member 100 one after another. Generally, the cylinder block 84 (or individual cylinder bodies), the cylinder head member 92 and the crankcase member 100 together define an engine body 110. Preferably, at least these major engine portions 84, 92, 94, 100 are made of aluminum alloy. The aluminum alloy advantageously increases strength over cast iron while decreasing the weight of the engine body 110.

The engine 32 also comprises the air induction system 34. The air induction system 34 draws air from within the cavity 68 to the combustion chambers 96. The air induction system 34 preferably comprises four intake passages 116. In the illustrated arrangement, the intake passages 116 are unified with each other to form a plenum chamber 118 at the most-upstream portions thereof.

The most-downstream portions of the intake passages 116 are defined within the illustrated cylinder head member 92 as a set of inner intake passages 120. The inner intake passages 120 communicate with the combustion chambers 96 through intake ports, which are formed at inner surfaces of the cylinder head member 92. Typically, each of the combustion chambers 96 has one or more intake ports. Intake valves 124 are slideably disposed in the cylinder head member 92 to move between an open position and a closed position. As such, the intake valves 124 act to open and close the intake ports to control the flow of air into the combustion chamber 96. Typically, biasing members, such as, for example, springs, are used to urge the intake valves 124 toward the respective closed positions by acting between a mounting boss formed on each cylinder head member 92 and a corresponding retainer that is affixed to each of the intake valves 124. When the intake valves 124 are in the open position, the inner intake passages 120 communicate with the associated combustion chambers 96.

Outer intake passages 126 connect the inner intake passages 120 with the plenum chamber 118 in the illustrated arrangment. Intake runners 128 preferably define downstream portions of the respective outer intake passages 126. Unified chamber and conduit member 130 defines the plenum chamber 118 and upstream portions of the respective outer intake passages 126 in one arrangment. In other words, a plenum chamber section 132 and intake conduit section 134, which has separate conduits, can be unitarily formed with the unified member 130. The intake conduit section 134 can of course be separately formed from the plenum chamber section 132. As used through this description, any terms such as "plenum chamber section," "plenum chamber member" or "voluminous member" mean a section or member that defines the plenum chamber 118. Also, any terms such as "intake conduit section," "intake conduit" or "runner" means a section or member that defines a portion or portions of the intake passages 116. In addition, the term "intake passage" may include the plenum chamber 118 in the broad sense of the word.

Throttle bodies 136 preferably connect the downstream portions of the outer intake passages 126 with the associated upstream portions. The runners 128 extend generally laterally from the cylinder head member 92 on the port side and curve generally forwardly. Forward of the throttle bodies 136, the intake conduit section 134 extends from the runners 128 generally forwardly along a side surface of the engine body 110 such that the plenum chamber section 132 is located at a forward position within the cowling. A large portion of the plenum chamber section 132 is located more forwardly than a front end of the crankcase member 100 in the illustrated arrangement.

The runners 128 and the throttle bodies 136 preferably are made of aluminum alloy, while the unified member 130 preferably is made of plastic. Appropriate fasteners such as, for example, bolts are used to couple the respective components 128, 136, 130 with one another disposed next thereto.

Each throttle body 136 preferably contains a throttle valve 140. Preferably, the throttle valves 140 are butterfly valves that have valve shafts 142 journalled for pivotal movement about a generally vertical axis. The valve shafts 142 preferably are linked together and are connected to a control linkage. Otherwise, the valve shafts 142 are separately connected to the control linkage. The control linkage can be connected to an operational member, such as a throttle lever, that is provided on the watercraft 40 or otherwise proximate the operator of the watercraft 40. The operator can control the opening degree, i.e., angular position, of the throttle valves 140 in accordance with the operator's demand through the control linkage. The throttle valves 140 can regulate or measure an amount of air that flows through the intake passages 116 to the combustion chambers 96 in response to the operation of the operational member by the operator. Normally, the greater the opening degree, the higher the rate of airflow and the higher the engine speed. As noted earlier, however, this relationship is not necessarily linear.

The plenum chamber section 132 has an air inlet duct 146 slightly extending toward the center plane 88 from a side surface of the section 132. The air inlet duct 146 defines an air inlet opening 148 through which the plenum chamber 118 communicates with the cavity 68. The plenum chamber 118 coordinates the air before delivering air to each intake passage 116. The plenum chamber 132 also acts as a silencer to reduce intake noise. In other words, the plenum chamber 118 can reduce pulsation energy within the induction system 34 resulting in a smoother airflow that is introduced to the combustion chambers 96.

The air within the closed cavity 68 is drawn into the plenum chamber 118 through the inlet opening 148 as indicated by the arrow 152 of FIG. 2. The air is smoothed in the plenum chamber 118 while moving to the intake passages 126 as indicated by the arrow 154 and intake noise is reduced. The air moves through the respective upstream portions of the outer intake passages 126, which is defined by the intake conduit section 134 in the illustrated arrangement, toward the portions defined by the throttle bodies 136, as indicated by the arrow 156. An air flow amount is regulated by the throttle valves 140 in the throttle bodies 136. The air then passes through the respective downstream portions of the outer intake passages 126, which are defined by the runners 128 in the illustrated arrangement, to the inner intake passages 120, as indicated by the arrow 158. The air then enters the combustion chambers 96 while the intake valves 124 are in the open position.

The engine 32 further comprises an exhaust system 160 that routes burnt charges, i.e., exhaust gases, to a location outside of the outboard motor 30. The illustrated cylinder head member 92 defines a set of inner exhaust passages 162 that communicate with the combustion chambers 96 through one or more exhaust ports defined in the inner surface of the cylinder head member 92. The exhaust ports can be selectively opened and closed by exhaust valves 166. The construction of each exhaust valve is substantially the same as the intake valve. Thus, further description of these components is deemed unnecessary.

An exhaust manifold 170 preferably is along a portion of cylinder block 84 and desirably extends generally vertically next to a bank of the cylinder bores 86. The exhaust manifold 170 communicates with the combustion chambers 96 through the inner exhaust passages 162 and the exhaust ports to collect exhaust gases therefrom as indicated by the arrow 171. In the illustrated arrangement, the exhaust manifold 170 is coupled with the exhaust discharge passage of the exhaust guide member 80. When the exhaust ports are opened, the combustion chambers 96 communicate with the exhaust discharge passage through the exhaust manifold 170.

A valve cam mechanism (not shown) preferably is provided for actuating the intake and exhaust valves 124, 166. Preferably, the valve cam mechanism includes one or more camshafts that extend generally vertically and that are journalled for rotation on and within a cylinder head cover member 172. The camshafts have cam lobes to push valve lifters that are affixed to the respective ends of the intake and exhaust valves 124, 166 in any suitable manner. The cam lobes repeatedly push the valve lifters in a timed manner, which is in proportion to the engine speed. The movement of the lifters generally is timed by rotation of the camshafts to appropriately actuate the intake and exhaust valves 124, 166.

A camshaft drive mechanism (not shown) preferably is provided for driving the valve cam mechanism. The intake and exhaust camshafts can be provided with intake and exhaust driven sprockets positioned atop the intake and exhaust camshafts, respectively, while the crankshaft 104 has a drive sprocket positioned atop thereof. A timing chain or belt is wound around the driven sprockets and the drive sprocket. The crankshaft 104 thus drives the respective camshafts through the timing chain in the timed relationship. Because the camshafts must rotate at half of the speed of the rotation of the crankshaft 104 in a four-cycle engine, a diameter of the driven sprockets is twice as large as a diameter of the drive sprocket.

The engine 32 preferably has indirect, port or intake passage fuel injection system 176. The fuel injection system 176 preferably comprises four fuel injectors 178 with one fuel injector allotted for each one of the respective combustion chambers 96. Preferably, the fuel injectors 178 are mounted on the most-downstream portions of the runners 128, and a fuel rail connects the respective fuel injectors 178 with each other. The fuel rail also defines a portion of fuel conduits to deliver fuel to the injectors 178.

Each fuel injector 178 preferably has an injection nozzle directed to the inner intake passage 120. The fuel injectors 178 spray fuel into the intake passages 116, as indicated by the arrows 180 of FIG. 2, under control of the ECU 182, for combustion in the combustion chambers 96. The fuel injectors 178 are connected to an electronic control unit (ECU) 182 through appropriate control lines. The ECU 182 controls both the initiation timing and the duration of the fuel injection cycle of the fuel injectors 178 so that the nozzles spray a proper amount of fuel during or prior to each combustion cycle.

Typically, a fuel supply tank disposed on a hull of the associated watercraft 40 contains the fuel. The fuel is delivered to the fuel rail through the fuel conduits and at least one fuel pump, which is arranged along the conduits. The fuel pump pressurizes the fuel to the fuel rail and finally to the fuel injectors 178.

A vapor separator 186 preferably is disposed along the fuel conduits to separate vapor from the fuel between the engine body 110 and the runners 128. The vapor separator 186 can be mounted on the engine body 110 along a port-side surface or on one or more of the runners 128, for example. The vapor can be directly delivered to the plenum chamber 118 through a vapor delivery passage 188 defined with a vapor delivery conduit 190. Otherwise, the vapor can travel through camshaft chambers formed between the cylinder head member 92 and the cylinder head cover member 172 and then can be directed to the plenum chamber 118 with a gaseous component that has been divided from blow-by gases and/or oil mist in the engine body 110 through the vapor delivery passage 188. The vapor and/or the gaseous component are also drawn into the plenum chamber 118 as indicated by the arrow 192 of FIG. 2. The engine 32 may have an appropriate ventilation system for dividing the gaseous component from the blow-by gases and the oil mist.

A direct fuel injection system that sprays fuel directly into the combustion chambers can replace the indirect fuel injection system described above. Instead, any other charge forming devices, such as carburetors, can be used.

The engine 32 further comprises an ignition or firing system (not shown). Each combustion chamber 96 is provided with a spark plug which preferably is disposed between the intake and exhaust valves 124, 166. Each spark plug has electrodes that are exposed into the associated combustion chamber 96 and that are spaced apart from each other with a small gap. The spark plugs are connected to the ECU 182 through appropriate control lines and ignition coils. The spark plugs generate a spark between the electrodes to ignite an air/fuel charge in the combustion chamber 96 at selected ignition timing under control of the ECU 182.

The illustrated ECU 182 controls at least the fuel injection system 176 and the ignition system based upon signals sent from sensors through sensor lines. Thus, the engine 32 may have various sensors. For instance, a crankshaft angle position sensor 176 preferably is provided to monitor the crankshaft 104. The angle position sensor, when measuring crankshaft angle versus time, outputs a crankshaft rotational speed signal or an engine speed signal that can be sent to the ECU 182. That is, the sensor can sense not only a specific crankshaft angle but also a rotational speed of the crankshaft 104, i.e., engine speed. An air intake pressure sensor preferably is positioned at any location within the intake passage 116. The intake pressure sensor senses the intake pressure in this passage 116 during engine operation. A throttle valve position sensor preferably is provided atop and proximate the valve shaft 142 of the upper-most throttle valve 140. The throttle valve position sensor senses an opening degree or angular position of the throttle valves 140. Of course, other sensors are available and additional sensors can be selected to complement any control strategies planned for use by the ECU 182.

The ECU 182 preferably uses control maps or functional equations to implement any desired control strategies. Adjustments on the desired injection timing and duration and/or on the ignition timing can be previously incorporated within the control maps or functional equations so that the optimum air/fuel ratio can be obtained under various environmental or operating conditions sensed by the sensors. The illustrated ECU 182 can be disposed in front of the crankcase member 100 and preferably is mounted thereto. In other arrangements, one or more stays can extend from a bottom of the lower cowling member 72 to support the ECU 182.

The engine 32 also can comprise other systems, devices, components and members. For example, a water cooling system and lubrication system also can be provided. These systems, devices, components and members are conventional and further descriptions are deemed unnecessary.

In the illustrated engine 32, the pistons 90 reciprocate between top dead center and bottom dead center. When the crankshaft 104 makes two rotations, the pistons 90 generally move from the top dead center position to the bottom dead center position (the intake stroke), from the bottom dead center position to the top dead center position (the compression stroke), from the top dead center position to the bottom dead center position (the power stroke) and from the bottom dead center position to the top dead center position (the exhaust stroke). During the four strokes of the pistons 90, the camshafts make one rotation and actuate the intake and exhaust valves 124, 166 to open the intake and exhaust ports 122, 164 during the intake stroke and the exhaust stroke, respectively.

Generally, during the intake stroke, air is drawn into the combustion chambers 96 through the air intake passages 116 and fuel is injected into the intake passages 116 by the fuel injectors 178. The air and the fuel thus are mixed to form the air/fuel charge in the combustion chambers 96. The air/fuel ratio generally is maintained at or about an optimum condition under control of the ECU 182 by determining an amount of the fuel that will properly correspond to an amount of the air. Slightly before or during the power stroke, the respective spark plugs ignite the compressed air/fuel charge in the respective combustion chambers 96. The air/fuel charge thus rapidly burns during the power stroke to move the pistons 90. The burnt charge, i.e., exhaust gases, then are discharged from the combustion chambers 96 during the exhaust stroke.

With reference again to FIG. 1, the driveshaft housing 62 is positioned generally below the exhaust guide member 80 and contains a driveshaft 200 which extends generally vertically through the driveshaft housing 62. The driveshaft 200 is journalled for rotation and is driven by the crankshaft 104. The driveshaft housing 62 preferably defines an internal section 202 of the exhaust system 160 that leads the majority of exhaust gases to the lower unit 64. The internal section 202 preferably includes an idle discharge portion that is branched off from a main portion of the internal section 202 to discharge idle exhaust gases directly out to the atmosphere when the engine 32 is idling. The exhaust internal section 202 is schematically shown in FIG. 1 to include a portion of the exhaust manifolds and the exhaust discharge passage.

The lower unit 64 depends from the driveshaft housing 62 and supports a propulsion shaft 206 that is driven by the driveshaft 200. The propulsion shaft 206 extends generally horizontally through the lower unit 64 and is journalled for rotation. A propulsion device is attached to the propulsion shaft 206. In the illustrated arrangement, the propulsion device is a propeller 208 that is affixed to an outer end of the propulsion shaft 206. The propulsion device, however, can take the form of a dual counter-rotating system, a hydrodynamic jet, or any of a number of other suitable propulsion devices.

A transmission 210 preferably is provided between the driveshaft 200 and the propulsion shaft 206, which lie generally normal to each other (i.e., at a 90° shaft angle) to couple together the two shafts 200, 206 by bevel gears or any other suitable arrangement. The outboard motor 30 preferably has a clutch mechanism that allows the transmission 210 to change the rotational direction of the propeller 208 among forward, neutral or reverse.

The lower unit 64 also defines an internal section of the exhaust system 160 that is connected with the internal exhaust section 202 of the driveshaft housing 62. At engine speeds above idle, the exhaust gases generally are discharged to the body of water surrounding the outboard motor 30 through the internal sections and then a discharge section defined within the hub of the propeller 208. Additionally, the exhaust system 160 can include a catalytic device at any location in the exhaust system 160 to purify the exhaust gases.

Figure 3:
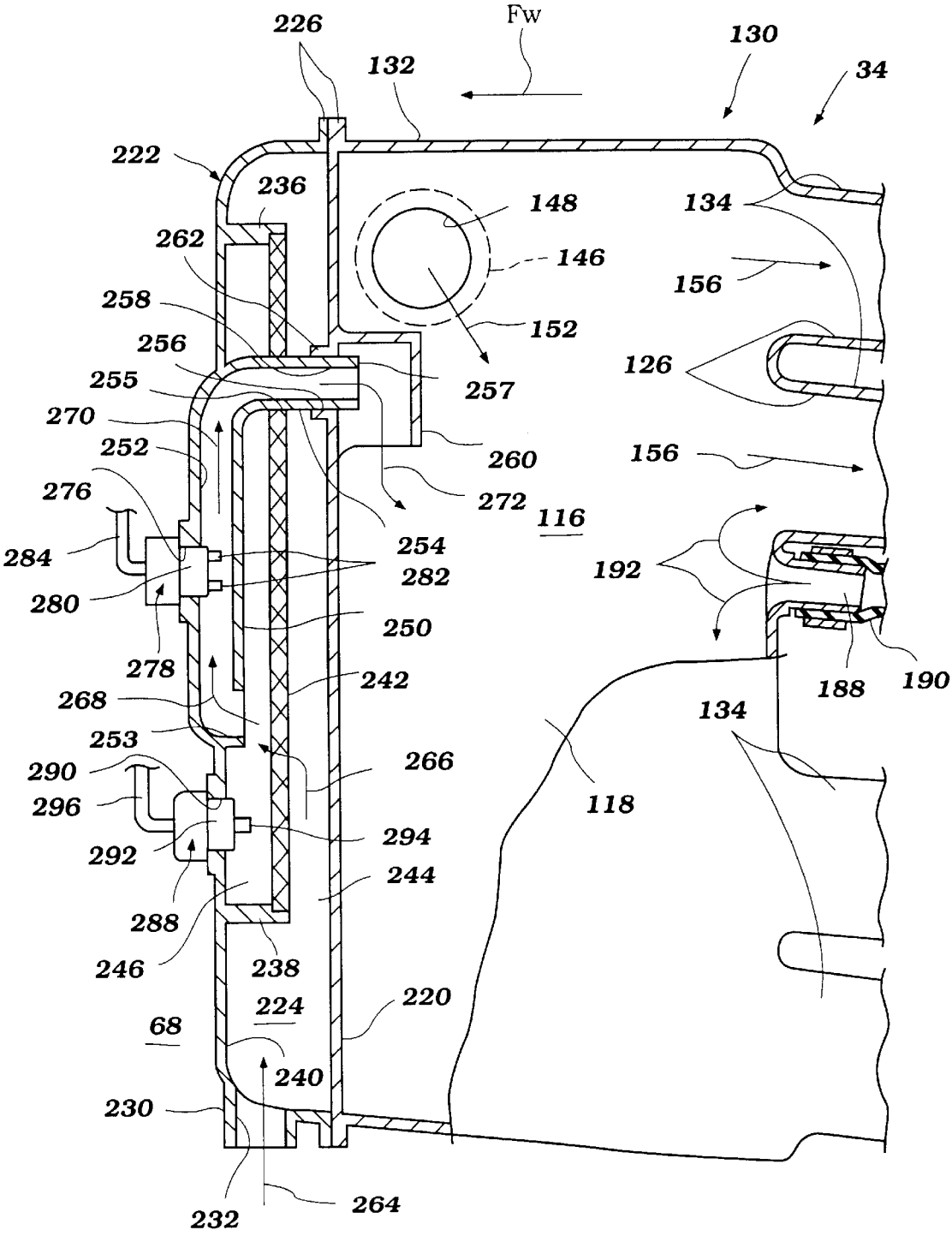
FIG. 3 is a partial side elevation view of an air induction system of the engine of FIG. 1. A portion of the induction system is illustrated in section.
Figure 4:
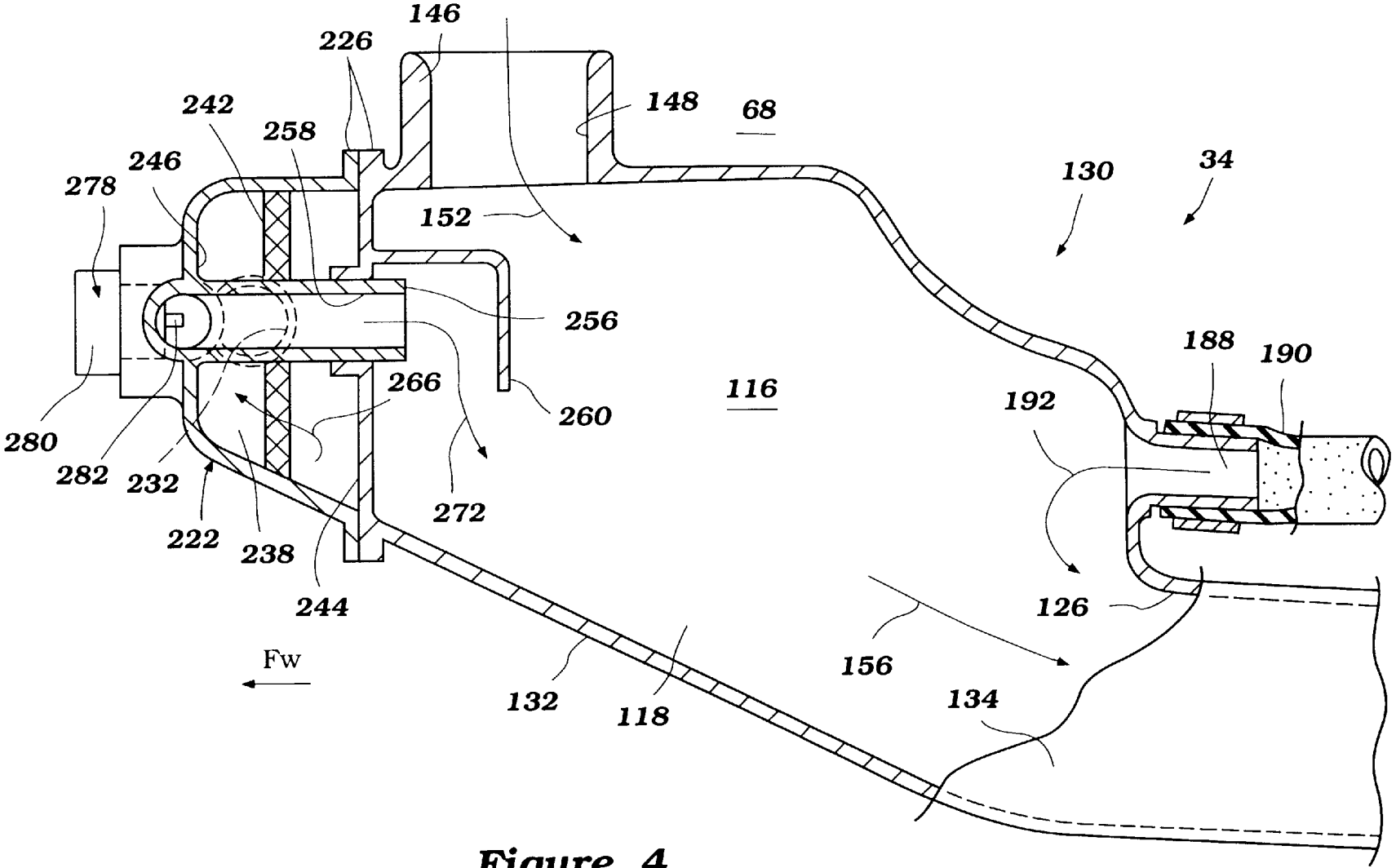
FIG. 4 is a partial top plan view of the air induction system of FIG. 3. A portion of the induction system is illustrated in section.

With reference to FIGS. 1 and 2, and additionally with reference to FIGS. 3 and 4, the air induction system 34 will now be described in greater detail below. A front end portion 220 of the plenum chamber section 132 can be formed generally flat. A recessed member or a side conduit member 222, which generally is configured as a cup-like shape, preferably is coupled with the front end portion 220 to define a secondary intake passage 224. The passage 224 is termed a "secondary intake passage" because the foregoing intake passages 116 generally form "primary intake passages" with primary and secondary meaning the relative types of air supply supported by the passages. The recessed member 222 preferably is made of plastic. Preferably, both the front end portion 220 and the side conduit member 222 have flanges 226 facing with each other and are affixed together by appropriate fasteners such as, for example, bolts. A projection 230 extends downwardly from a bottom end of the recessed member 222 and defines an inlet opening 232 through which the air in the cavity 68 is drawn into the secondary passage 224.

Upper and lower stay sections 236, 238 extend from an inner surface 240 of the recessed member 222 toward the front end portion 220 of the plenum chamber section 132. The upper and lower stay sections 236, 238 are unitarily formed with the recessed member 222. An air filter 242 preferably is mounted on the stay sections 236, 238 to divide the secondary passage 224 into an upstream portion or chamber 244 and a downstream portion or chamber 246. The illustrated filter 242 is configured generally flat as a plate-like shape. The air filter 242 preferably is made of breathable material such as, for example, an unwoven cloth. Otherwise, a metallic or plastic fine mesh can be applicable in some extent.

A conduit section 250 that can be unitarily formed with the recessed member 222 extends vertically along the inner surface 240 thereof within the downstream portion 246 to define a path 252. An inlet opening 253 of the path 252 is defined at a bottom end of the illustrated conduit section 250. A top portion 254 of the conduit section 250 turns generally rearwardly toward the front end portion 220 of the plenum chamber section 132 by penetrating through an aperture 255 of the air filter 242 and the upstream portion 244 of the secondary passage 224. The front end portion 220 of the plenum chamber section 132 defines an aperture 256 in proximity to the inlet opening 148 of the plenum chamber 118 and a distal end 257 of the conduit section 250 extends through the aperture 256. Thus, an outlet opening 258 of the path 252 is defined adjacent to the inlet opening 148 of the plenum chamber 118 in the illustrated arrangement.

A cover section, baffle or visor 260 is unitarily formed with the front end portion 220 of the plenum chamber section 132 to isolate the outlet opening 258 of the path 252 from the inlet opening 148 of the plenum chamber 118. The illustrated cover section 260 generally is configured as a box-like shape that has a top surface, a rear surface and a lateral surface on the starboard side, but does not have a bottom surface and a lateral surface on the port side because the inlet opening 148 of the plenum chamber 116 is positioned slightly higher than the outlet opening 258 of the path 252 and on the starboard side. The cover section 260 thus can effectively inhibit water mist or water splash from entering the outlet opening 258 of the path 252. The illustrated cover section 260 can also inhibit the vapor and/or the gaseous component from the vapor delivery conduit 190 from entering the path 252. Furthermore, a flange 262 preferably extends oppositely into the upstream portion 244 of the secondary passage 224 to securely support the top portion 254 of the conduit section 250.

The air in the cavity 68 is drawn into the upstream portion 244 of the secondary passage 224 through the inlet opening 232 defined at the projection 230 as indicated by the arrow 264. The air then moves into the downstream portion 246 through the air filter 242 as indicated by the arrow 266. Alien substances such as, for example, water mist, dirt and/or other particles contained in the air are removed by the air filter 242. The cleaned air enters the path 252 as indicated by the arrow 268 and passes toward the outlet opening 258 as indicated by the arrow 270. Finally, the air moves into the plenum chamber 118 through the outlet opening 258 to merge with the air within the plenum chamber 118 as indicated by the arrow 272. Because the cover section 260 is restrictively opened at the bottom surface and the lateral surface on the port side, the air can flow into the plenum chamber 118 only through these surfaces. The air to the secondary passage 224 is drawn by the negative pressure generated in the combustion chambers 96 that draws the air to the plenum chamber 118 directly through the inlet opening 148.

The recessed member 222 preferably defines an aperture 276 on the outer surface thereof at the path 252. An air flow meter or airflow sensor 278 is mounted on the outer surface of the recessed member 222 so that a sensor body 280 thereof extends through the aperture 276. Sensor tips 282 thus are exposed to the airflow in the path 252. Any conventional types of flow meters can be applied such as, for example, a hot-wire (heated wire) type, a moving vane type and a Karman Vortex type. These flow meters can sense an amount of air by detecting changes in temperature of a wire, in pivotal angle of a vane and in number of curls, respectively. In other words, the flow meters detect a change of flow velocity. Accordingly, the term "flow meter" or "airflow sensor" can include an airflow velocity sensor. The flow meter 278 is connected with the ECU 182 through a signal line 284 to deliver a sensed signal to the ECU 182. The flow meter 278 can accurately sense a current amount of the air passing through the path 252.

The ECU 182 can use this signal for the control of the fuel injection system 176 and the ignition system. Advantageously, the air amount passing through the path 252 thus is proportion to the air amount that enters the plenum chamber 118 through the inlet opening 148. The arrangement in which the secondary passage 246 open to the plenum chamber 118 is quite advantageous because the plenum chamber 118 smoothes the air therein and hence stable negative pressure can draw the air in the secondary passage 224. The accurate control by the ECU 182 can be aided in accordingly. For instance, the ECU 182 recognizes how much amount of air is supplied to the combustion chambers 96 during a unit time and then calculates a corresponding injection timing and duration of the fuel injection based upon the recognition of the air amount to obtain the optimum air/fuel ratio.

Conventional flow meters generally are sensitive to, example, dust, water, and particularly salt water. However, as described above, the air filter 242 can remove those substances from the air and the flow meter 278 is thereby greatly protected from such substances. The air filter 242, however, can become clogged over time with the substances if not cleaned or properly maintained. If this occurs, the air amount entering the path 252 decreases and the sensor signal from the flow meter 278 also decreases. The ECU 182 therefore should recognize the degree to which the air amount in the path 252 is decreased by clogging and desirably should adjust the output signal from the flow meter 278 accordingly.

In the illustrated arrangement, an intake pressure sensor 288 is provided to sense an intake pressure in the downstream portion 246 of the secondary passage 224. This is because if the filter 242 is clogged, the intake pressure in the downstream portion 246 inevitably decreases. That is, the intake pressure sensor 288 can watch how much the intake pressure decreases from a preset pressure and the ECU 182 can adjust the signal from the flow meter 278 based upon the signal from the intake pressure sensor 288. More specifically, if the intake pressure in the downstream portion 246 decreases, the ECU 182 calculates an adjustment amount in generally inverse proportion to the intake pressure so that an accurate amount of air flow in the entire induction system can be calculated.

The recessed member 222 preferably defines an aperture 290 on the outer surface thereof below the path 252. The intake pressure sensor 288 is mounted on the outer surface of the recessed member 222 so that a sensor body 292 thereof extends through the aperture 290. A sensor tip 294 thus is exposed to the airflow in the second portion 246 but out of the path 252. The sensed signal from the intake pressure sensor 288 is sent to the ECU 182 through a signal line 296. Other sensors can replace the intake pressure sensor 288 if the sensors can sense a change from a preset condition of the air passing through the secondary passage 224.

The intake pressure sensor 288 can be used not only as a sensor sending the signal for the adjustment but also as a sensor sending a signal that is normally used by the ECU 182. Preferably, however, another intake pressure sensor is provided for the normal control because the output of intake pressure sensor 288 varies with the condition of the filter 242.

In the illustrated embodiment, the filter 242 removes substantially all the alien substances, including salt water, before the air enters the downstream portion 246. Thus, the flow meter 278 can well be protected from corrosion and can be expected to have reasonable lifetime. In addition, the filter 242 divides the secondary passage 224, which apparently is smaller than the plenum chamber, into two portions 244, 246 so that the flow meter 278 is disposed in the downstream portion 246. Because of this, the filter 250 can be quite small in comparison with a construction that places such a filter in the plenum chamber 118. It should be noted that the filter 242 is not necessarily configured in a plate-like shape. For example, a wave form or a bellows form can be applied to make the filter 242 more compact while maintaining a desirable amount of surface area. Such a construction would decrease the overall size of the box needed to provide an adequate surface area for filtration.

Figure 5:
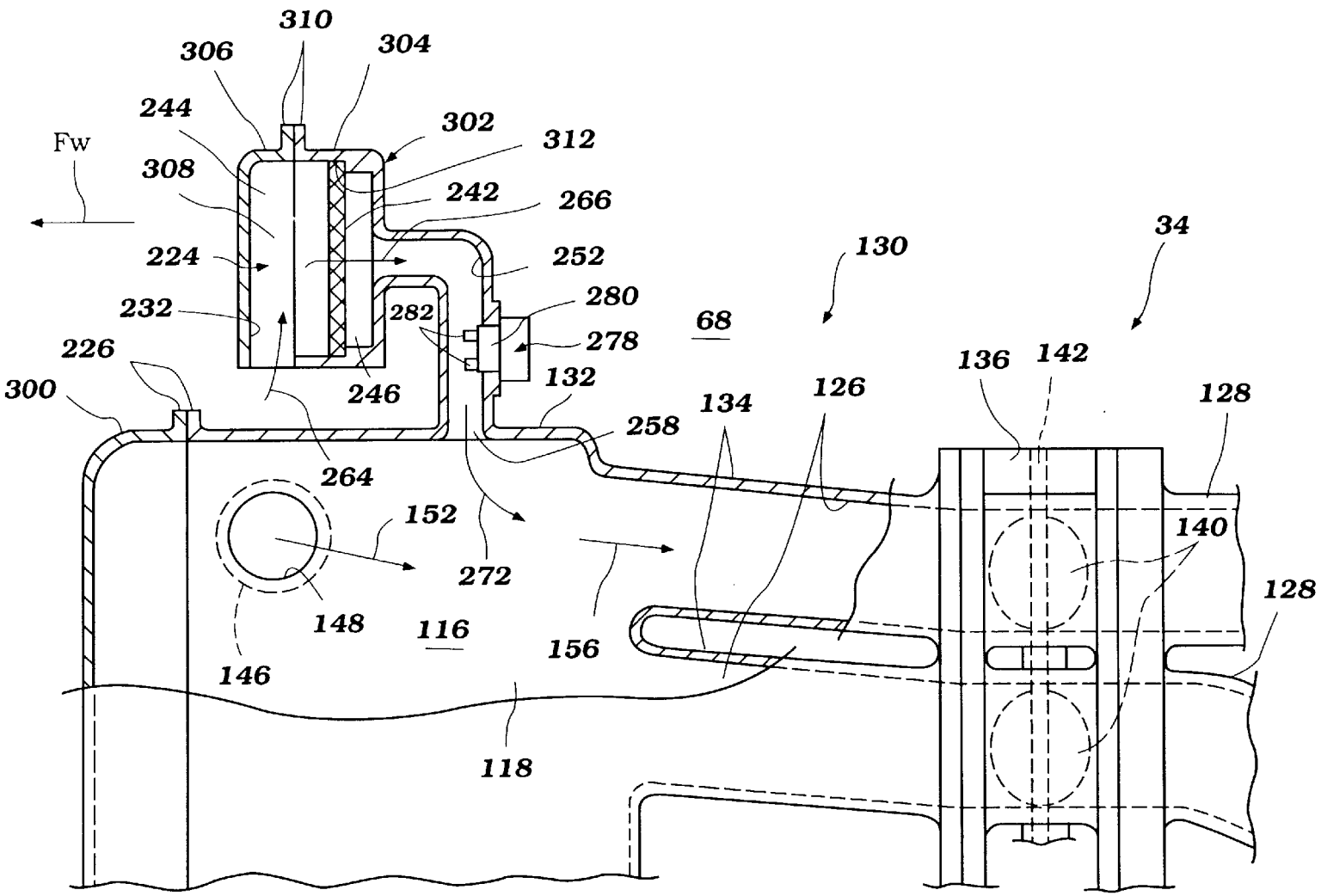
FIG. 5 is a partial side elevation view of another air induction system configured in accordance with certain features, aspects and advantages of the present invention. A portion of the induction system is illustrated in section.

FIG. 5 illustrates another construction that is arranged and configured in accordance with certain features, aspects and advantages of the present invention. The same components and members that have already been described above are assigned the same reference numerals and will not be described again.

The plenum chamber section 132 in this arrangement is widely opened forwardly and a closure member 300 is affixed to the plenum chamber section 132 to close the opening (as compared to the recessed member 222 of the first arrangement). A pathway section 302 preferably extends generally upwardly from a top portion of the plenum chamber section 132 to form a secondary passage 224 of this arrangement. The pathway section 302 preferably is unitarily formed with the plenum chamber section 132. The pathway section 302 can be formed with a separate member from the plenum chamber section 132 in some arrangements.

The pathway section 302 preferably comprises a hollow post portion 304 and a cover member 306. A lower end of the post portion 304 communicates with the plenum chamber 118 through an outlet opening 258. The post portion 304 extends generally upwardly and turns forwardly. A forward end of the post portion 304 expands to form an inlet chamber 308 together with the cover member 306. The post portion 304 and the cover member 306 preferably have flanges 310 and are coupled with each other by affixing the flanges 310 by appropriate fasteners such as, for example, bolts, clips or the like. The cover member 306 preferably is made of plastic.

An air filter 242 preferably extends generally vertically in the inlet chamber 308 to divide the secondary passage 224 into an upstream portion 244 and a downstream portion 246. More specifically, a step 312 is made at the chamber area of the post portion 304 with the downstream portion 246 having a slightly smaller diameter than the other part of the chamber area. The filter 242 is disposed on the step 312. Because the secondary passage 224 can be formed small enough to allow nominal air to flow, the filter 242 in this arrangement can be much smaller than the filter 242 in the first embodiment.

A bottom end of the cover member 306 preferably defines an air inlet opening 232 of the secondary passage 224 together with a forward bottom end of the post portion 304. This inlet opening advantageously can face the plenum chamber 118 such that the air flow path become more tortuous. The air in the cavity 68 is drawn into the upstream portion 244 through the inlet opening 232 as indicated by the arrow 264 of FIG. 5. The air then passes through the air filter 242 enroute to the downstream portion 246 as indicated by the arrow 266 of FIG. 5. The air then moves into the plenum chamber 118 through the inlet opening 258 as indicated by the arrow 272 of FIG. 5.

An air flow meter 278 in this arrangement preferably is mounted on a vertical area of the post portion 304 to place sensor tips 282 within the downstream portion 246. No other sensor is provided in this arrangement. However, a sensor sensing a change from a preset condition of the secondary passage 224, such as an intake pressure sensor, of course can be provided in the passage 224, in the downstream chamber 246 or in the post portion 304.

Figure 6:
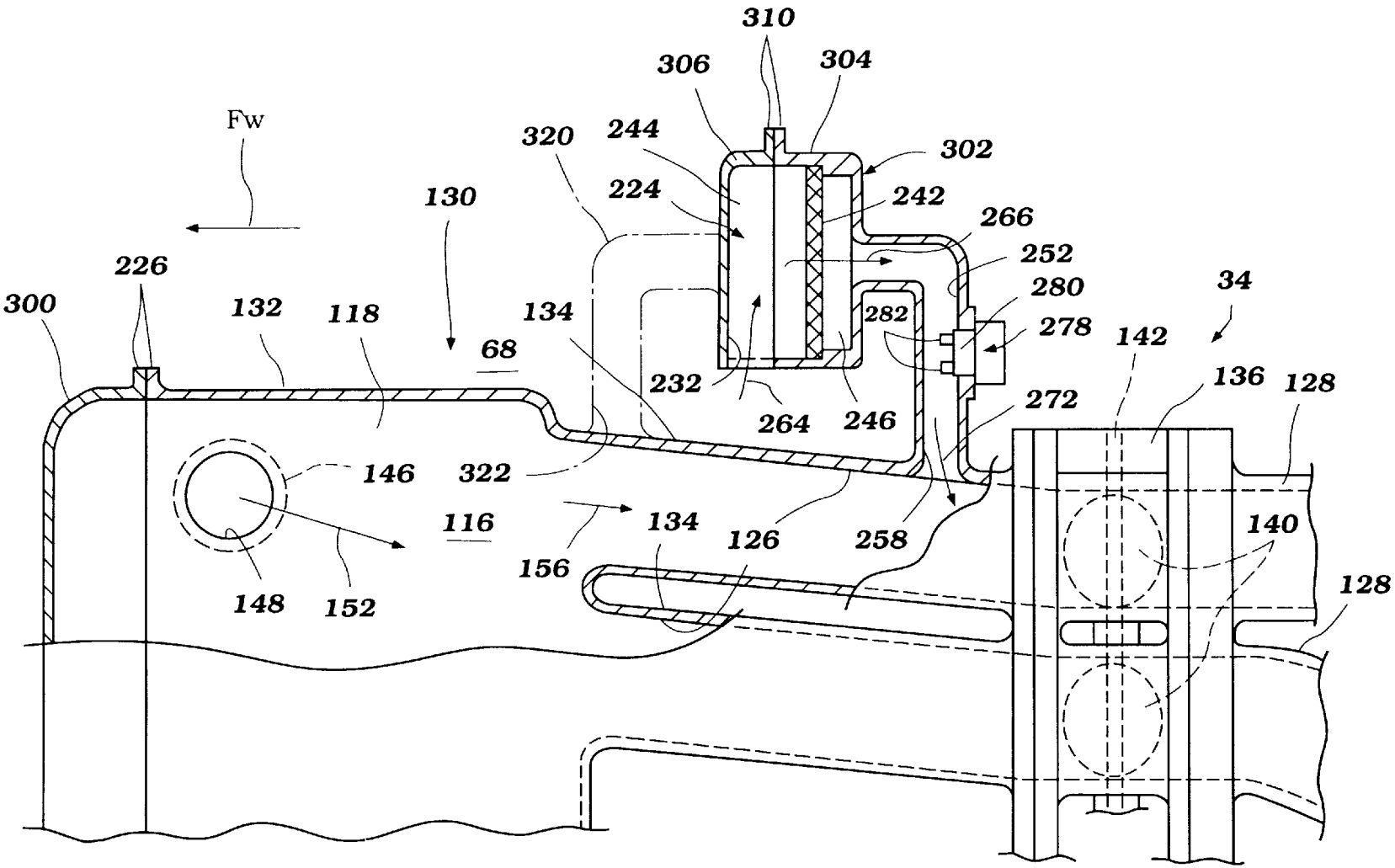
FIG. 6 is a partial side elevation view of a further air induction system configured in accordance with certain features, aspects and advantages of the present invention. A portion of the induction system is illustrated in section.

FIG. 6 illustrates a further arrangement that is arranged and configured in accordance with certain features, aspects and advantages of the present invention. The same components and members that have already been described above are assigned the same reference numerals and will not be described again. A pathway section 302 in this arrangement is positioned at the upper-most intake conduit section 134 so that the secondary passage 224 communicates with the upper-most intake passage 126 through an outlet opening 258. The construction and structure generally are the same as the pathway section 302 of the second embodiment described above.

In some arrangements, another post portion 320, which might be unitarily formed with the cover member 306, can extend from an upstream portion of the upper-most intake conduit section 134 or the plenum chamber section 132 as indicated in phantom. An inlet opening 322 can be formed at the location where the post portion 320 extends so that the secondary passage 224 communicates with the upper-most intake passage 126 or the plenum chamber 118 through the inlet opening 322. In such arrangements, the cover member 306 preferably has no inlet opening at the bottom end thereof. A portion of the air in the upper-most intake passage 126 thus bypasses the passage 126 and flows through the secondary passage 224 and then moves into the passage 126 to merge with the other portion of the air that passes through the upper-most intake passage 126.

Of course, the foregoing description is that of preferred constructions having certain features, aspects and advantages in accordance with the present invention. Various changes and modifications may be made to the above-described arrangements without departing from the spirit and scope of the invention, as defined by the appended claims.

What is claimed is:

1. An internal combustion engine comprising an engine body, a combustion chamber defined at least partially within said engine body, an air induction system arranged to introduce air into the combustion chamber, the air induction system comprising a primary intake passage through which the air flows, a secondary intake passage extending from the primary passage and communicating with the primary passage, the secondary passage adapted to supply at least a portion of the air flowing through the air induction system, a filter disposed in the secondary passage, and an airflow sensor positioned downstream of the filter in the secondary passage to sense a flow amount of the portion of the air flowing through the secondary passage.

2. The engine as set forth in claim 1, wherein the primary passage has a first inlet port, and the secondary passage has a second inlet port separately defined from the first inlet port.

3. The engine as set forth in claim 1, wherein the secondary passage bypasses a portion of the primary passage.

4. The engine as set forth in claim 1, wherein the primary passage has an air inlet port through which the air enters the primary passage, the secondary passage communicates with the primary passage through an opening positioned in proximity to the inlet port, and the primary passage comprises a baffle to isolate the opening from the inlet port.

5. The engine as set forth in claim 1, wherein the air induction system additionally includes a second sensor positioned downstream of the filter to sense a change from a preset condition of the air passing through the secondary passage.

6. The engine as set forth in claim 5, wherein the second sensor includes an intake pressure sensor to sense an intake pressure within the secondary passage.

7. The engine as set forth in claim 1 additionally comprising at least one fuel injector arranged to spray fuel for combustion in the combustion chamber, and a control device arranged to control the fuel injector based upon a signal from the airflow sensor.

8. The engine as set forth in claim 7, wherein the air induction system additionally comprises an intake pressure sensor positioned downstream of the filter to sense an intake pressure within the secondary passage, and the control device being arranged to control the fuel injector based upon a signal from the intake pressure sensor.

9. The engine as set forth in claim 1 additionally comprising a throttle valve disposed within the primary passage to regulate an amount of the air, and the secondary passage communicating with the primary passage upstream of the throttle valve.

10. The engine as set forth in claim 1, wherein said engine body defines a plurality of combustion chambers, the air induction system includes a plurality of the primary passages, the primary passages are unified together upstream of the plurality of combustion chambers to form a plenum chamber, and the secondary passage has an opening to communicate with the plenum chamber.

11. The engine as set forth in claim 10, wherein a plenum chamber member defines the plenum chamber, and a recessed member is coupled with the plenum chamber member to define the secondary passage between the recessed member and the plenum chamber member.

12. The engine as set forth in claim 11, wherein the filter defines upstream and downstream portions in the secondary passage, and the airflow sensor is disposed within the downstream portion.

13. The engine as set forth in claim 12, wherein the filter defines the downstream portion with an inner surface of the recessed member.

14. The engine as set forth in claim 13, wherein the airflow sensor is mounted on the recessed member.

15. The engine as set forth in claim 14, wherein the upstream portion is positioned between the plenum chamber and the downstream portion, and a tubular member penetrates through the upstream portion to connect the downstream portion with the plenum chamber.

16. The engine as set forth in claim 10, wherein a portion of the plenum chamber member has an air inlet port through which the air enters the plenum chamber, the secondary passage communicates with the plenum chamber through an opening positioned in proximity to the inlet port, and the portion of the plenum chamber member defines a baffle to isolate the opening from the inlet port.

17. The engine as set forth in claim 10, wherein the airflow sensor is mounted on the recessed member.

18. The engine as set forth in claim 1, wherein a plurality of the moveable members are moveable relative to the engine body, the engine body and the moveable members together define a plurality of combustion chambers, the air induction system includes a plurality of the primary passages, the primary passages are unified together upstream thereof to form a plenum chamber, and the secondary passage has an opening to communicate with the plenum chamber.

19. The engine as set forth in claim 1, wherein a plurality of the moveable members are moveable relative to the engine body, the engine body and the moveable members together define a plurality of combustion chambers, the air induction system includes a plurality of the primary passages, and the secondary passage has an opening to communicate with one of the primary passages.

20. The engine as set forth in claim 1, wherein a plurality of the moveable members are moveable relative to the engine body, the engine body and the moveable members together define a plurality of combustion chambers, the air induction system includes a plurality of the primary passages, the primary passages are unified together upstream thereof, and the secondary passage bypasses a portion of one of the primary passages.

21. The engine as set forth in claim 1, wherein the engine operates on a four-cycle combustion principle.

22. The engine as set forth in claim 1, wherein the engine powers a marine propulsion device.

23. An internal combustion engine comprising an engine body, a plurality of moveable members moveable relative to the engine body, the engine body and the moveable members together defining a plurality of combustion chambers, an air induction system arranged to introduce air into the combustion chambers, the air induction system including a voluminous member defining a plenum chamber, a plurality of intake conduits defining at least portions of intake passages connecting the plenum chamber with the combustion chambers, a recessed member coupled with the voluminous member to define an air passage communicating with the plenum chamber, a filter disposed within the air passage to divide the air passage into upstream and downstream portions, and a flow meter positioned in the downstream portion to sense a flow amount of the air flowing through the air passage.

24. The engine as set forth in claim 23, wherein the filter defines the downstream portion with an inner surface of the recessed member.

25. The engine as set forth in claim 24, wherein the upstream portion is positioned between the plenum chamber and the downstream portion, and the air induction system additionally includes a tubular member extending through the upstream portion to connect the downstream portion with the plenum chamber.

26. The engine as set forth in claim 23, wherein the flow meter is mounted on an inner surface of the recessed member.

27. The engine as set forth in claim 23, wherein the voluminous member has an air inlet port through which the air enters the plenum chamber, the air passage communicates with the plenum chamber through an opening positioned in proximity to the inlet port, and the voluminous member defines a visor to isolate the opening from the inlet port.

28. The engine as set forth in claim 23, wherein the air induction system additionally includes a sensor positioned downstream of the filter to sense a change from a preset condition of the air passing through the air passage.

29. The engine as set forth in claim 28, wherein the sensor includes an intake pressure sensor to sense an intake pressure within the air passage.

30. An internal combustion engine comprising an engine body, a moveable member moveable relative to the engine body, the engine body and the moveable member together defining a combustion chamber, and an air induction system arranged to introduce air into the combustion chamber, the air induction system including an intake conduit through which the air flows, a side conduit extending from the intake conduit, at least a portion of the air flowing through the side conduit, a filter disposed in the side conduit to filtrate the portion of the air, and means for sensing a flow amount of the portion of the air, the sensing means being positioned downstream of the filter in the side conduit.

* * * * *